US010982567B2

(12) United States Patent
Fukunaga et al.

(10) Patent No.: US 10,982,567 B2
(45) Date of Patent: Apr. 20, 2021

(54) CONDENSATE AND FEEDWATER SYSTEM OF STEAM POWER PLANT AND OPERATION METHOD FOR THE SAME

(71) Applicant: Mitsubishi Power, Ltd., Yokohama (JP)

(72) Inventors: Hiroshi Fukunaga, Yokohama (JP); Supriyo Datta, Yokohama (JP)

(73) Assignee: Mitsubishi Power, Ltd., Yokohama (JP)

( * ) Notice: Subject to any disclaimer, the term of this patent is extended or adjusted under 35 U.S.C. 154(b) by 0 days.

(21) Appl. No.: 16/710,879

(22) Filed: Dec. 11, 2019

(65) Prior Publication Data

US 2020/0271019 A1 Aug. 27, 2020

(30) Foreign Application Priority Data

Feb. 21, 2019 (JP) ..... JP2019-029753

(51) Int. Cl.
*F01K 13/02* (2006.01)
*F22D 1/00* (2006.01)
*F01K 9/02* (2006.01)

(52) U.S. Cl.
CPC ..... *F01K 13/02* (2013.01); *F01K 9/023* (2013.01); *F22D 1/003* (2013.01)

(58) Field of Classification Search
CPC . F01K 13/02; F01K 9/023; F01K 7/40; F22D 1/003; F22D 5/26
(Continued)

(56) References Cited

U.S. PATENT DOCUMENTS 2,656,823 A * 10/1953 Hillier ..... B01D 19/0063 122/441
3,894,391 A 7/1975 Heitmann et al.
(Continued)

FOREIGN PATENT DOCUMENTS

JP 60-219404 A 11/1985
WO WO 2016/13192 A1 8/2016

OTHER PUBLICATIONS

Hindi-language Office Action issued in Indian Application No. 201914051059 dated Sep. 15, 2020 with English translation (six (6) pages).

*Primary Examiner* — Hoang M Nguyen
(74) *Attorney, Agent, or Firm* — Crowell & Moring LLP

(57) ABSTRACT

A condensate and feedwater system includes: a deaerator circulation pump that returns condensate water flowing out from a deaerator to a part of a condensate line between a heater and the deaerator; an apparatus to be supplied with part of the condensate water flowing from the heater toward the deaerator, through a supply line branched from the condensate line; a supply line shutoff valve that switches between communication and interruption of the supply line; and a controller that controls opening/closing of the supply line shutoff valve and driving/stopping of the deaerator circulation pump. The controller closes the supply line shutoff valve from an open state at normal operation and at least temporarily drives the deaerator circulation pump from a stopped state at normal operation, in condenser throttling in which supply of extraction steam of a steam turbine to the heater and the deaerator is reduced as compared to that at normal operation and a deaerator water level control valve is closed.

12 Claims, 8 Drawing Sheets

(58) Field of Classification Search
USPC ..... 60/653, 654, 663, 677–680
See application file for complete search history.

(56) References Cited

U.S. PATENT DOCUMENTS

| | | | | |
|---|---|---|---|---|
| 4,345,438 | A * | 8/1982 | Labbe | B01D 19/0063 60/657 |
| 4,732,004 | A | 3/1988 | Brand et al. | |
| 8,955,320 | B2 * | 2/2015 | Xiang | F28D 20/0056 60/641.8 |
| 9,169,744 | B2 | 10/2015 | Schuele et al. | |
| 2010/0326074 | A1 * | 12/2010 | Okita | F01K 7/04 60/648 |
| 2011/0041503 | A1 * | 2/2011 | Hirakawa | F01D 21/14 60/646 |
| 2013/0263928 | A1 * | 10/2013 | Inoue | F01K 7/44 137/11 |

* cited by examiner

CONDENSATE AND FEEDWATER SYSTEM OF STEAM POWER PLANT AND OPERATION METHOD FOR THE SAME

BACKGROUND OF THE INVENTION

1. Field of the Invention

The present invention relates to a condensate and feedwater system of a steam power plant and an operation therefor, more specifically to a condensate and feedwater system including a deaerator circulation system and an operation therefor.

2. Description of the Related Art

A steam power plant drives a steam turbine by high-temperature high-pressure steam generated by a steam generation source such as a boiler and a nuclear reactor, thereby generating electric power. The steam having driven the steam turbine is condensed in a condenser to become condensate water, which is supplied to the steam generation source to become steam again, and the steam is supplied to the steam turbine. In a condensate water system and feedwater system of a steam power plant, in general, the condensate water generated in the condenser is sent out by a condensate water pump, is heated by a low pressure feedwater heater, and is then heated and deaerated in a deaerator. Thereafter, the condensate water, i.e. feedwater, deaerated in the deaerator is raised in pressure by a boiler feedwater pump, is further heated by a high pressure feedwater heater, and is then supplied to the steam generation source again. The deaerated feedwater is stored in the deaerator, and the feedwater in the deaerator is maintained at a predetermined water level by a deaerator water level control valve. Extraction steam from the steam turbine is used for heating in the low pressure feedwater heater, the high pressure feedwater heater, and the deaerator.

A steam power plant generally includes a deaerator circulation system in which a deaerator circulation pump circulates feedwater from a downstream side of the deaerator to an upstream side via a deaerator circulation line. See, for example, FIG. 1 of JP-1985-219404-A. In the steam power plant, at start-up of the plant, feedwater in the deaerator is circulated through the deaerator circulation line by the deaerator circulation pump, thereby swiftly deaerating the feedwater. In addition, at a load rejection or a rapid load reduction in the plant, the feedwater in the deaerator is circulated through the deaerator circulation line by the deaerator circulation pump, whereby balance between temperature and pressure of feedwater in the deaerator and those on the upstream of the boiler feedwater pump is maintained, thereby mitigating flashing. The deaerator circulation system is normally not operated in situations other than the above-mentioned, for example, at normal operation.

Some steam power plants separate part of condensate water flowing toward the deaerator and supply the separated water to an apparatus. In a condensate water system and feedwater system of a steam power plant including such an apparatus, as, for example, depicted in FIG. 10, a first supply line SL1 branched from a part of a condensate line CL between a low pressure feedwater heater LH and a deaerator D is connected to an inlet side of the apparatus H. The first supply line SL1 leads part of the condensate water flowing from the low pressure feedwater heater LH toward the deaerator D to the apparatus H. A first supply line shutoff valve VS1 and a transfer pump PS are provided on the first supply line SL1, in this order from the upstream side. A second supply line SL2 different from the first supply line SL1 is connected to the inlet side of the apparatus H. The second supply line SL2 supplies the apparatus H with water from another supply source different from the condensate water flowing on the condensate line CL. A second supply line shutoff valve VS2 is provided on the second supply line SL2.

In the steam power plant illustrated in FIG. 10, in normal operation, part of the condensate water flowing on the condensate line CL from the low pressure feedwater heater LH toward the deaerator D is branched into the first supply line SL1 by the transfer pump PS, passes through the apparatus H via the first supply line shutoff valve VS1, and is then introduced into the deaerator D. On the other hand, the remaining part of the condensate water flows on the condensate line CL and is introduced directly to the deaerator D. In normal operation, the second supply line shutoff valve VS2 is closed, and, therefore, supply of water to the apparatus H via the second supply line SL2 is interrupted.

SUMMARY OF THE INVENTION

Incidentally, in a steam power plant, other than normal operation, there is an operation called condensate throttling for coping with a rapid load increase. The condensate throttling is an operation in which the flow rate of condensate water supplied to the low pressure feedwater heater and the deaerator are reduced rapidly, whereby supply of extraction steam from a steam turbine used for heating in the low pressure feedwater heater and the deaerator is reduced, and an output power of the steam turbine is increased accordingly. In the condensate throttling, a deaerator water level control valve is closed rapidly, whereby the flow rate of condensate water is reduced rapidly.

In the steam power plant in which condensate water on the condensate line CL is supplied to the apparatus via the first supply line SL1 as described above, at the condensate throttling, as depicted in FIG. 11, the first supply line shutoff valve VS1 is closed to interrupt supply of condensate water to the apparatus H from the condensate line CL, and, on the other hand, the second supply line shutoff valve VS2 is opened to supply water to the apparatus H from another supply source. In general, the deaerator water level control valve VD is an air operated valve, whereas the first supply line shutoff valve VS1 and the second supply line shutoff valve VS2 is motor operated valves. While the air operated valve can be transferred rapidly from an open state to a closed state, the motor operated valve takes more time for reaching a closed state than the air operated valve. Therefore, at the time of switching from normal operation to condensate throttling, even after the deaerator water level control valve VD which is an air operated valve is closed rapidly, the first supply line SL1 is communicating with the condensate line CL without being interrupted, until the first supply line shutoff valve VS1 which is a motor operated valve is completely closed, for example, for several minutes. As a result, even after the condensate line CL is interrupted due to the rapid closure of the deaerator water level control valve VD, there is generated a period of time during which the condensate water on the downstream side of the deaerator water level control valve VD is supplied to the apparatus H via the first supply line SL1. For this reason, there is a fear that a part of the condensate line CL on the downstream side of the deaerator water level control valve VD, i.e. the part of alternate long and two short dashes line in FIG. 11, may not be filled up with water and that void may be generated there.

In a case where void is generated in the condensate line (pipeline) CL on the downstream side of the deaerator water level control valve VD, when the deaerator water level control valve VD in a closed state is opened for returning from the condensate throttling to the normal operation, the condensate water flows rapidly into the void part of the condensate line CL. Accordingly, there is a possibility of generation of a phenomenon called water hammer in which the pipeline receives a shock and is vibrated severely.

Thus, there is a need for a condensate and feedwater system of a steam power plant and an operation method therefor capable of preventing generation of water hammer at the time of returning from condensate throttling to normal operation, without changing an apparatus configuration of the steam power plant.

According to an aspect of the present invention, there is provided a condensate and feedwater system of a steam power plant including: a deaerator that heats and deaerates condensate water generated in a condenser, by extraction steam of a steam turbine, and temporarily stores the heated and deaerated condensate water; a heater disposed on a condensate line between the condenser and the deaerator, the heater being configured to heat the condensate water generated in the condenser, by extraction steam of the steam turbine; a deaerator water level control valve disposed on an upstream side of the heater in the condensate line, the deaerator water level control valve being capable of controlling water level of the condensate water in the deaerator; a deaerator circulation pump that returns condensate water flowing out from the deaerator to a part of the condensate line between the heater and the deaerator; an apparatus configured to be supplied with part of the condensate water flowing from the heater toward the deaerator, through a supply line branched from the condensate line; a supply line shutoff valve disposed on the supply line, the supply line shutoff valve being configured to switch between communication and interruption of the supply line; and a controller that controls opening/closing of the supply line shutoff valve and controls driving/stopping of the deaerator circulation pump. The controller puts the supply line shutoff valve into an open state and puts the deaerator circulation pump into a stopped state, in normal operation, and, on the other hand, closes the supply line shutoff valve from the open state at the normal operation, and at least temporarily drives the deaerator circulation pump from the stopped state at the normal operation, in condensate throttling in which supply of the extraction steam of the steam turbine to the heater and the deaerator is reduced as compared to that at the normal operation and the deaerator water level control valve is closed.

According to the present invention, the deaerator circulation pump of a conventional configuration is at least temporarily driven at the condensate throttling. Therefore, even in a case where the condensate line on the downstream side of the deaerator water level control valve is put out of the state of being filled up with water due to the switching from the normal operation to the condensate throttling, returning the condensate water flowing out from the deaerator to the condensate line on the upstream side of the deaerator allows the condensate line to be changed into the state of being filled up with water during the condensate throttling. Accordingly, generation of water hammer at the time of returning from the condensate throttling to the normal operation can be prevented, without changing the plant configuration.

The other problems, configurations, and effects concerning the present invention will be made clear by the following description of embodiments.

DESCRIPTION OF THE PREFERRED EMBODIMENTS

Figure 1:
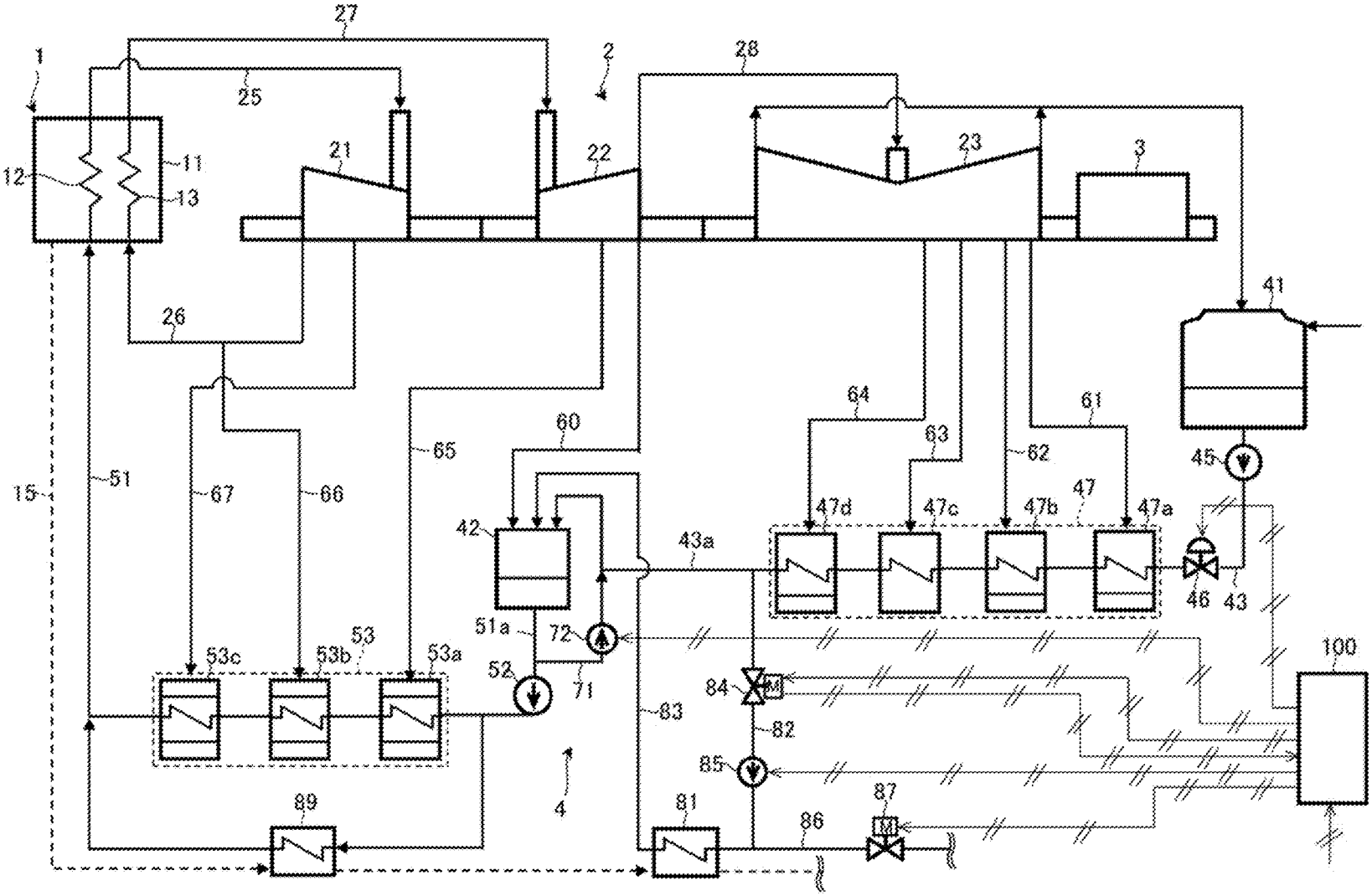
FIG. 1 is a system diagram depicting a configuration of a steam power plant including a condensate and feedwater system of a steam power plant according to one embodiment of the present invention.

A condensate and feedwater system of a steam power plant and an operation method for the same according to one embodiment of the present invention will be described below referring to the drawings.

One Embodiment

Figure 2:
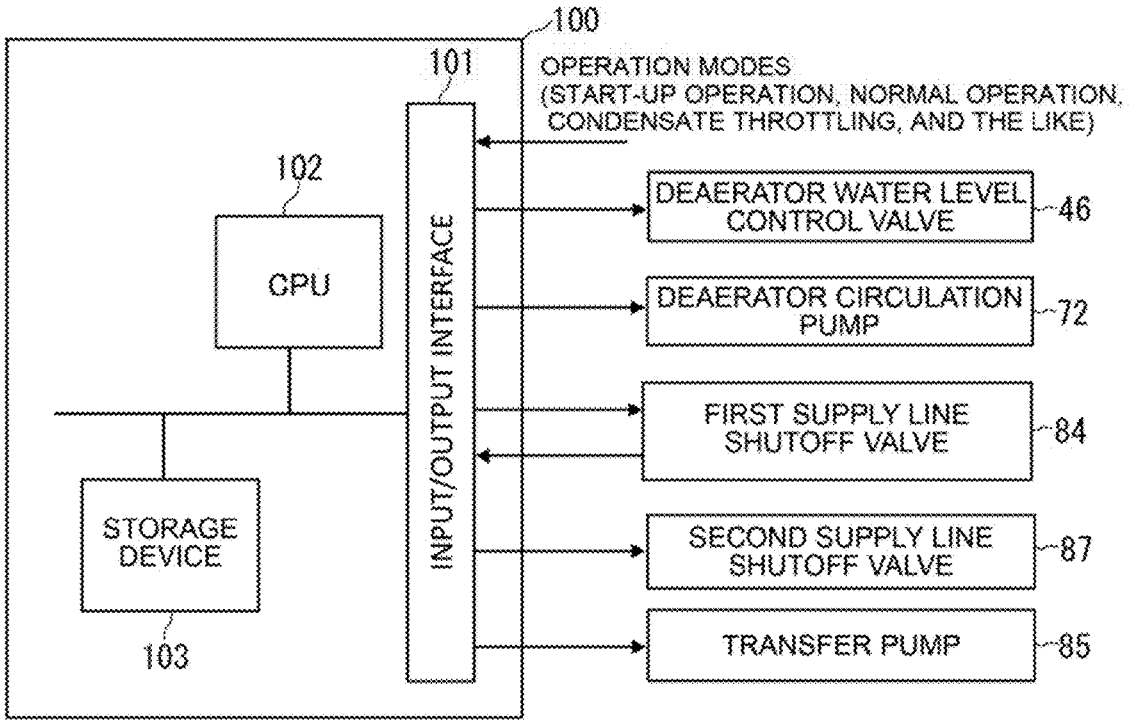
FIG. 2 is a configuration diagram depicting hardware of a controller constituting a part of the condensate and feedwater system of the steam power plant according to one embodiment of the present invention.

The configuration of a steam power plant including a condensate and feedwater system of a steam power plant according to one embodiment of the present invention will be described referring to FIGS. 1 and 2. FIG. 1 is a system diagram depicting the configuration of the steam power plant including the condensate and feedwater system of the steam power plant according to one embodiment of the present invention. FIG. 2 is a configuration diagram depicting hardware of a controller constituting a part of the condensate and feedwater system of the steam power plant according to one embodiment of the present invention.

In FIG. 1, the steam power plant includes a boiler 1 as a steam generation source that generates steam, a steam turbine 2 that is driven by steam generated in the boiler 1, and a generator 3 that is connected to the steam turbine 2 and generates electric power. The boiler 1 includes a furnace 11 in which to burn a fuel, a steam generator 12 that generates steam by combustion energy generated in the furnace 11, and a repeater 13 that heats the steam having driven a HP turbine 21 described later, by the combustion energy generated in the furnace 11. The steam turbine 2 includes, for example, the HP (High Pressure) turbine 21, an IP (Intermediate Pressure) turbine 22, and an LP (Low Pressure) turbine 23.

The steam generator 12 of the boiler 1 and an inlet side of the HP turbine 21 are connected through a main steam piping 25. An outlet side of the HP turbine 21 and the reheater 13 are connected through a cold reheat piping 26. The reheater 13 of the boiler 1 and an inlet side of the IP turbine 22 are connected through a hot reheat piping 27. An outlet side of the IP turbine 22 and an inlet side of the LP turbine 23 are connected through a connecting steam piping 28.

The steam power plant further includes a condensate and feedwater system 4 that supplies the boiler 1 with condensate water generated by condensation of steam discharged from the steam turbine 2 (LP turbine 23) as feedwater. The condensate and feedwater system 4 includes a condenser 41 that cools the steam discharged from the steam turbine 2 (LP turbine 23) to produce condensate water, and a deaerator 42 that deaerates the condensate water by heating. The deaerator 42 also has a function of temporarily storing the deaerated condensate water therein. The deaerator 42 is supplied with steam extracted from the IP turbine 22 via a deaeration extraction steam piping 60 as a heating medium for the condensate water.

A condensate water pump 45, a deaerator water level control valve 46, and an LP heater 47 are disposed on a condensate line 43 between the condenser 41 and the deaerator 42, in this order from the upstream side. The condensate water pump 45 raises the pressure of the condensate water from the condenser 41 and delivers the pressure-raised condensate water to the LP heater 47. The deaerator water level control valve 46 controls the water level of the condensate water stored in the deaerator 42. As the deaerator water level control valve 46, there is used, for example, an air operated valve. The LP heater 47 is a heater that heats the condensate water by the steam extracted from the steam turbine 2 as a heating medium, for enhancing the thermal efficiency of the power plant. The LP heater 47 includes, for example, a first LP heater 47*a*, a second LP heater 47*b*, a third LP heater 47*c*, and a fourth LP heater 47*d*, in this order from the upstream side. The first LP heater 47*a*, the second LP heater 47*b*, the third LP heater 47*c*, and the fourth LP heater 47*d* are supplied with steam extracted from the LP turbine 23 via a first extraction steam piping 61, a second extraction steam piping 62, a third extraction steam piping 63, and a fourth extraction steam piping 64, respectively.

A feedwater pump 52 and an HP heater 53 are disposed on a feedwater line 51 between the deaerator 42 and the boiler 1, in this order from the upstream side. The feedwater pump 52 raises the pressure of feedwater from the deaerator 42 and delivers the pressure-raised feedwater to the boiler 1 via the HP heater 53. The HP heater 53 heats condensate water by the steam extracted from the steam turbine 2 as a heating medium, for enhancing the thermal efficiency of the power plant. The HP heater 53 includes, for example, a first HP heater 53*a*, a second HP heater 53*b*, and a third HP heater 53*c*, in this order from the upstream side. The first HP heater 53*a* is supplied with the steam extracted from the IP turbine 22 through a fifth extraction steam piping 65. The second HP heater 53*b* and the third HP heater 53*c* are supplied with the steam extracted from the HP turbine 21 through a sixth extraction steam piping 66 and a seventh extraction steam piping 67, respectively.

One end side of a deaerator circulation line 71 is connected to a part 51*a* between the deaerator 42 and the feedwater pump 52, of the feedwater line 51, while the other end side of the deaerator circulation line 71 is connected to a part 43*a* between the LP heater 47 (the fourth LP heater 47*d* disposed on the most downstream side) and the deaerator 42, of the condensate line 43. A deaerator circulation pump 72 is disposed on the deaerator circulation line 71. The deaerator circulation pump 72 returns the condensate water flowing out of the deaerator 42 to an inlet side (upstream side) of the deaerator 42 via the deaerator circulation line 71. That is, the condensate and feedwater system 4 includes a deaerator circulation system that is constituted by the deaerator circulation line 71 and the deaerator circulation pump 72.

The condensate and feedwater system 4 further includes a condensate heat exchanger 81 which is an apparatus to be supplied with part of the condensate water flowing from the LP heater 47 toward the deaerator 42. The condensate heat exchanger 81 heats part of the condensate water flowing from the LP heater 47 toward the deaerator 42, by an exhaust gas from the boiler 1. The condensate heat exchanger 81 is disposed on an exhaust gas system 15 in which the exhaust gas of the boiler 1 flows.

A first supply line 82 branched from the part 43*a* between the fourth LP heater 47*d* and the deaerator 42, of the condensate line 43, is connected to an inlet side of the condensate heat exchanger 81. An outlet side of the condensate heat exchanger 81 is connected to the deaerator 42 via an outlet line 83. A first supply line shutoff valve 84 and a transfer pump 85 are disposed on the first supply line 82, in this order from the upstream side. The first supply line shutoff valve 84 switches between communication and interruption of the first supply line 82. As the first supply line shutoff valve 84, there is used, for example, a motor operated valve. The transfer pump 85 transfers part of the condensate water flowing through the condensate line 43, to the condensate heat exchanger 81.

A second supply line 86 different from the first supply line 82 is connected to a part on the downstream side from the transfer pump 85, of the first supply line 82. The second supply line 86 supplies the condensate heat exchanger 81 with water from a supply source different from the condensate water flowing through the condensate line 43*a*. A second supply line shutoff valve 87 is disposed on the second supply line 86. The second supply line shutoff valve 87 switches between communication and interruption of the second supply line 86. As the second supply line shutoff valve 87, there is used, for example, a motor operated valve.

By switching opening/closing of the first supply line shutoff valve 84 and the second supply line shutoff valve 87, either one of part of the condensate water flowing through the condensate line 43*a* and the water from the supply source different from the condensate water flowing through the condensate line 43*a* is supplied to the condensate heat exchanger 81.

In addition, the condensate and feedwater system 4 further includes a feedwater heat exchanger 89 connected in parallel with the HP heater 53. The feedwater heat exchanger 89 heats part of feedwater sent from the feedwater pump 52 toward the HP heater 53, by the exhaust gas from the boiler 1. The feedwater heat exchanger 89 is disposed on the upstream side from the condensate heat exchanger 81, of the exhaust gas system 15.

Each of the deaerator water level control valve 46, the first supply line shutoff valve 84, and the second supply line shutoff valve 87 of the condensate and feedwater system 4 is electrically connected to a controller 100. The first supply line shutoff valve 84, upon completing transfer from an open state to a closed state by control of the controller 100, detects the closed state and outputs a closure detection signal to the controller 100. Each of the deaerator circulation pump 72 and the transfer pump 85 of the condensate and feedwater system 4 is electrically connected to the controller 100.

The controller 100 at least controls opening/closing of the deaerator water level control valve 46, the first supply line shutoff valve 84, and the second supply line shutoff valve 87, and controls driving/stopping of the deaerator circulation pump 72 and the transfer pump 85. The controller 100 can also be configured to control driving/stopping of the condensate water pump 45 and the feedwater pump 52. However, in the present embodiment, the description concerning the control of the condensate water pump 45 and the feedwater pump 52 by the controller 100 is omitted. As, for example, depicted in FIG. 2, the controller 100 includes an input/output interface 101, a central processing unit (CPU) 102, and a storage device 103 such as a read only memory (ROM) and a random access memory (RAM).

Commands for operation modes such as start-up operation, normal operation (rated load operation), and condensate throttling of the steam power plant are inputted to the input/output interface 101. In addition, the closure detection signal from the first supply line shutoff valve 84 is inputted to the input/output interface 101. A control program including processing steps according to the flow chart described later and various kinds of information necessary for executing the control program are stored in the storage device 103. The central processing unit 102 performs predetermined arithmetic processing according to the control program stored in the storage device 103, on the information taken in from the input/output interface 101 and the storage device 103. The input/output interface 101 produces command signals according to results of the arithmetic processing by the central processing unit 102, and outputs the command signals to various apparatuses. For example, an opening command signal for opening a valve and a closure command signal for closing a valve can be each outputted to the deaerator water level control valve 46, the first supply line shutoff valve 84, and the second supply line shutoff valve 87. In addition, a driving command signal for driving a pump and a stopping command signal for stopping a pump can be each outputted to the deaerator circulation pump 72 and the transfer pump 85.

Figure 3:
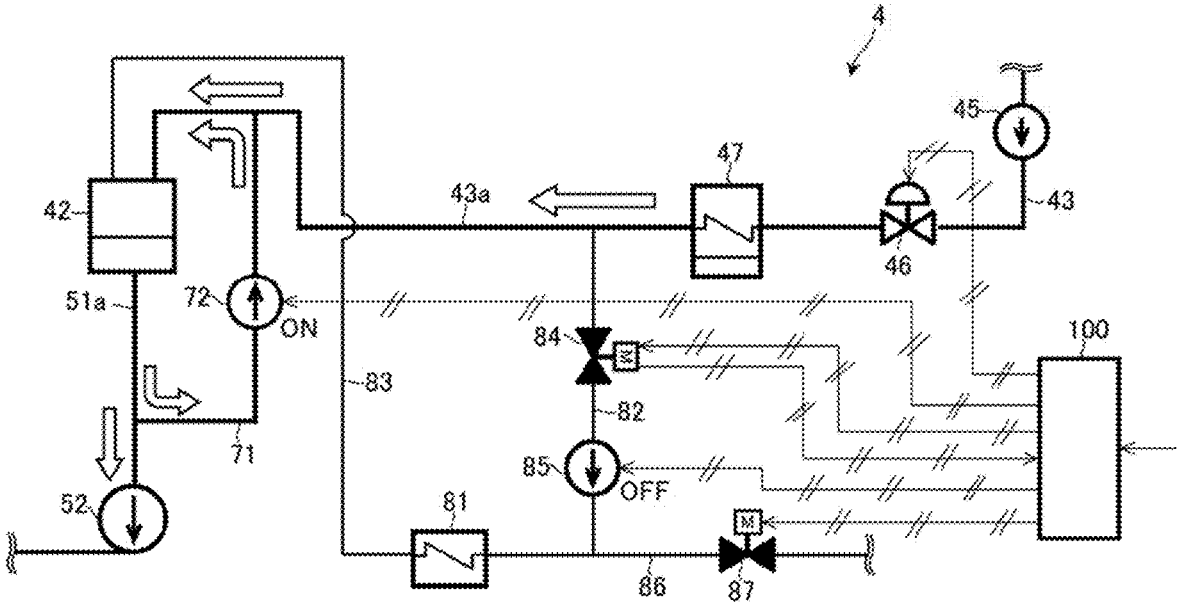
FIG. 3 is an illustration depicting an operation method at start-up of the plant in the condensate and feedwater system of the steam power plant according to one embodiment of the present invention.

Next, an operation method for the condensate and feedwater system of the steam power plant according to one embodiment of the present invention will be described below. First, an operation of the condensate and feedwater system at start-up of the steam power plant will be described referring to FIGS. 1 and 3. FIG. 3 is an illustration of an operation method at the start-up of the power plant in the condensate and feedwater system of the steam power plant according to one embodiment of the present invention.

At the start-up of the power plant, first, a clean step of lowering water quality (dissolved oxygen) of the feedwater to the boiler 1 depicted in FIG. 1 to or below a reference value is required. In view of this, condensate water is circulated through the deaerator 42 to perform speedy deaeration, thereby shortening start-up time of the power plant.

Specifically, the controller 100 depicted in FIG. 3 outputs an opening command signal to the deaerator water level control valve 46, and outputs closure command signals to the first supply line shutoff valve 84 and the second supply line shutoff valve 87. The deaerator water level control valve 46 is put into an open state in response to the opening command signal from the controller 100, and the condensate line 43 is put into a communicating state. On the other hand, the first supply line shutoff valve 84 and the second supply line shutoff valve 87 are put into a closed state in response to the closure command signals from the controller 100, whereby the first supply line 82 and the second supply line 86 are put into an interrupted state.

In addition, the controller 100 outputs a driving command signal to the deaerator circulation pump 72, and, on the other hand, outputs a stopping command signal to the transfer pump 85. The deaerator circulation pump 72 is put into a driven state in response to the driving command signal from the controller 100, whereas the transfer pump 85 is put into a stopped state in response to the stopping command signal from the controller 100. Note that the condensate water pump 45 and the feedwater pump 52 are in a driven state.

As a result, in the condensate and feedwater system 4, the condensate water in the condenser 41 (illustrated in FIG. 1) is caused to flow on the condensate line 43 by the condensate water pump 45, and flows into the deaerator 42 after passing through the LP heater 47. The condensate water having flowed into the deaerator 42 is deaerated by auxiliary steam from a steam generation source different from the steam turbine 2 and the boiler 1, and then flows out from the deaerator 42. Part of the condensate water having flowed out from the deaerator 42 is caused to flow into the deaerator 42 again via the deaerator circulation line 71 together with the condensate water flowing through the condensate line 43*a*, by driving of the deaerator circulation pump 72. The remaining part of the condensate water passes through the HP heater 53 and thereafter returns to the condenser 41 via a line which is not illustrated, by the feedwater pump 52. Note that the condensate heat exchanger 81 is not supplied with water since the first supply line 82 and the second supply line 86 are interrupted.

In this way, in the clean step of condensate water (feedwater) at the start-up of the power plant, the condensate water is circulated through the deaerator 42 via the deaerator circulation line 71 by driving of the deaerator circulation pump 72. Therefore, the flow rate of the condensate water circulated through the deaerator 42 is increased, so that deaeration time for the condensate water can be shortened, and start-up time of the power plant is shortened.

Figure 4:
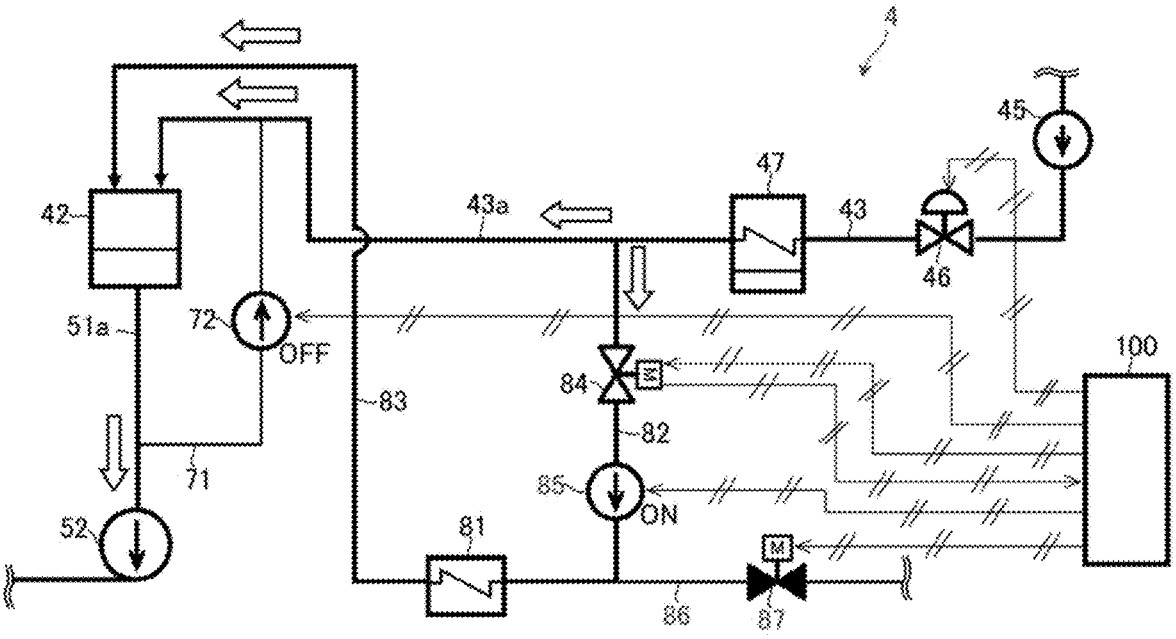
FIG. 4 is an illustration depicting an operation method at normal operation, i.e. rated load operation, of the plant in the condensate and feedwater system of the steam power plant according to one embodiment of the present invention.

Next, an operation method at the normal operation (rated load operation) of the steam power plant and an operation method at the normal operation of the condensate and feedwater system will be described referring to FIGS. 1 and 4. FIG. 4 is an illustration of an operation method at the normal operation (rated load operation) of the power plant in the condensate and feedwater system of the steam power plant according to one embodiment of the present invention.

High-temperature high-pressure steam is generated by the steam generator 12 of the boiler 1 illustrated in FIG. 1. The steam generated in the boiler 1 is supplied to the HP turbine 21 via the main steam piping 25, to rotationally drive the HP turbine 21. Low-temperature steam discharged from the HP turbine 21 is introduced into the boiler 1 again via the cold reheat piping 26, to be reheated by the reheater 13. The steam reheated by the reheater 13 is supplied to the IP turbine 22 via the hot reheat piping 27, to rotationally drive the IP turbine 22. The steam discharged from the IP turbine 22 is supplied to the LP turbine 23 via the connecting steam piping 28, to rotationally drive the LP turbine 23, and is thereafter introduced into the condenser 41. With the HP turbine 21, the IP turbine 22, and the LP turbine 23, i.e. steam turbines 2, rotationally driven, the generator 3 connected to the steam turbines 2 generates electric power. The amount of steam generated by the boiler 1 is controlled according to the load on the generator 3.

In the condensate and feedwater system 4, the steam from the LP turbine 23 is condensed into condensate water in the condenser 41. The condensate water in the condenser 41 is sequentially delivered to the first LP heater 47*a*, the second LP heater 47*b*, the third LP heater 47*c*, and the fourth LP heater 47*d* by the condensate water pump 45. In the first to fourth LP heaters 47*a*, 47*b*, 47*c*, and 47*d*, the condensate water is heated by extraction steam supplied from the LP turbine 23 via the first to fourth extraction steam piping 61, 62, 63, and 64. The condensate water heated by the LP heater 47 is introduced into the deaerator 42, where it is heated and deaerated by extraction steam supplied from the IP turbine 22 via the deaeration extraction steam piping 60. The thus deaerated condensate water is temporarily stored in the deaerator 42. The water level of the condensate water stored in the deaerator 42 is controlled to a predetermined level by regulating the degree of opening of the deaerator water level control valve 46.

The condensate water stored in the deaerator 42 is raised in pressure and sequentially delivered to the first HP heater 53*a*, the second HP heater 53*b*, and the third HP heater 53*c* by the feedwater pump 52. In the first HP heater 53*a*, the condensate water (feedwater) is heated by the extraction steam supplied from the IP turbine 22 via the fifth extraction steam piping 65. In the second and third HP heaters 53*b* and 53*c*, the condensate water (feedwater) is heated by the extraction steam supplied from the HP turbine 21 via the sixth and seventh extraction steam pipings 66 and 67, respectively. The feedwater heated by the HP heater 53 is supplied to the boiler 1, to become steam again. In the steam power plant, the normal operation is performed by such a series of circulation cycles.

In the normal operation of the power plant, the controller 100 depicted in FIG. 4 outputs the opening command signal to the first supply line shutoff valve 84, while outputting the closure command signal to the second supply line shutoff valve 87. The first supply line shutoff valve 84 is in an open state in response to the opening command signal from the controller 100 and the first supply line 82 is in a communicating state, whereas the second supply line shutoff valve 87 is in a closed state in response to the closure command signal from the controller 100 and the second supply line 86 is in an interrupted state.

In addition, the controller 100 outputs the driving command signal to the transfer pump 85, while outputting the stopping command signal to the deaerator circulation pump 72. The transfer pump 85 is in a driven state in response to the driving command signal from the controller 100, whereas the deaerator circulation pump 72 is in a stopped state in response to the stopping command signal from the controller 100.

As a result, in the condensate and feedwater system 4, part of the condensate water flowing on the condensate line 43 from the LP heater 47 toward the deaerator 42 is branched into the first supply line 82 and supplied to the condensate heat exchanger 81 through the first supply line shutoff valve 84 by the transfer pump 85. In the condensate heat exchanger 81, the condensate water is heated by an exhaust gas supplied from the boiler 1 via the exhaust gas system 15 (illustrated in FIG. 1). By this, thermal energy of the exhaust gas from the boiler 1 is recovered into the condensate water, so that thermal efficiency of the power plant as a whole is enhanced. The condensate water heated in the condensate heat exchanger 81 is introduced into the deaerator 42 via the outlet line 83, to join the condensate water introduced into the deaerator 42 by flowing through the condensate line 43. Note that the condensate heat exchanger 81 is not supplied with water via the second supply line 86 since the second supply line 86 is interrupted.

Figure 5:
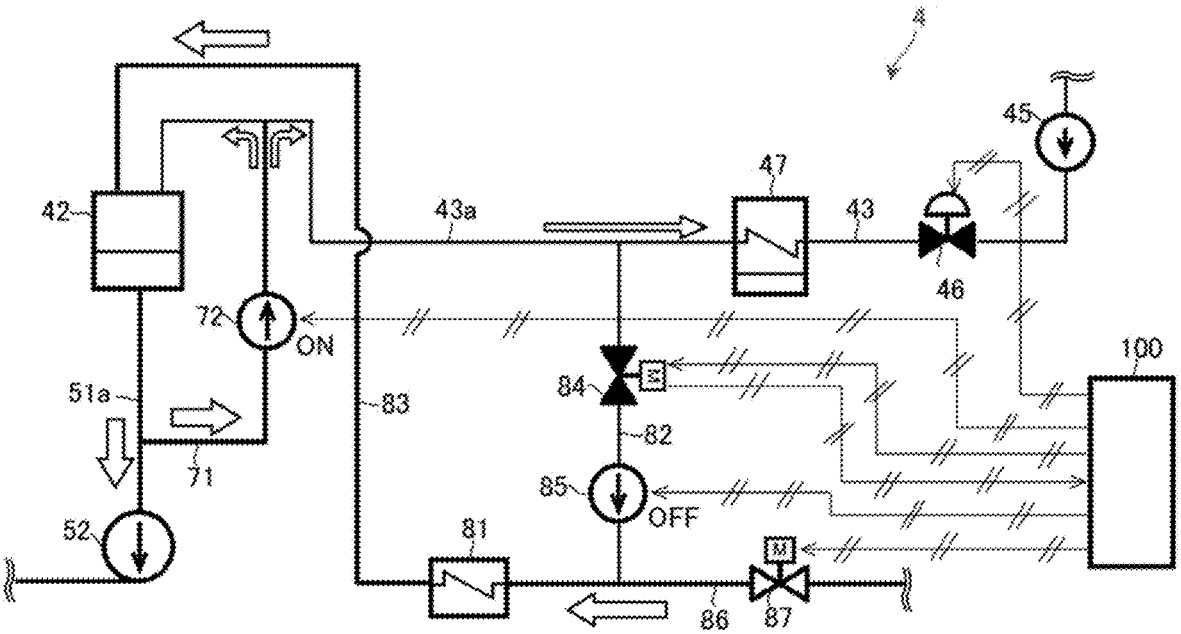
FIG. 5 is an illustration depicting an operation method at condensate throttling of the plant in the condensate and feedwater system of the steam power plant according to one embodiment of the present invention.
Figure 6:
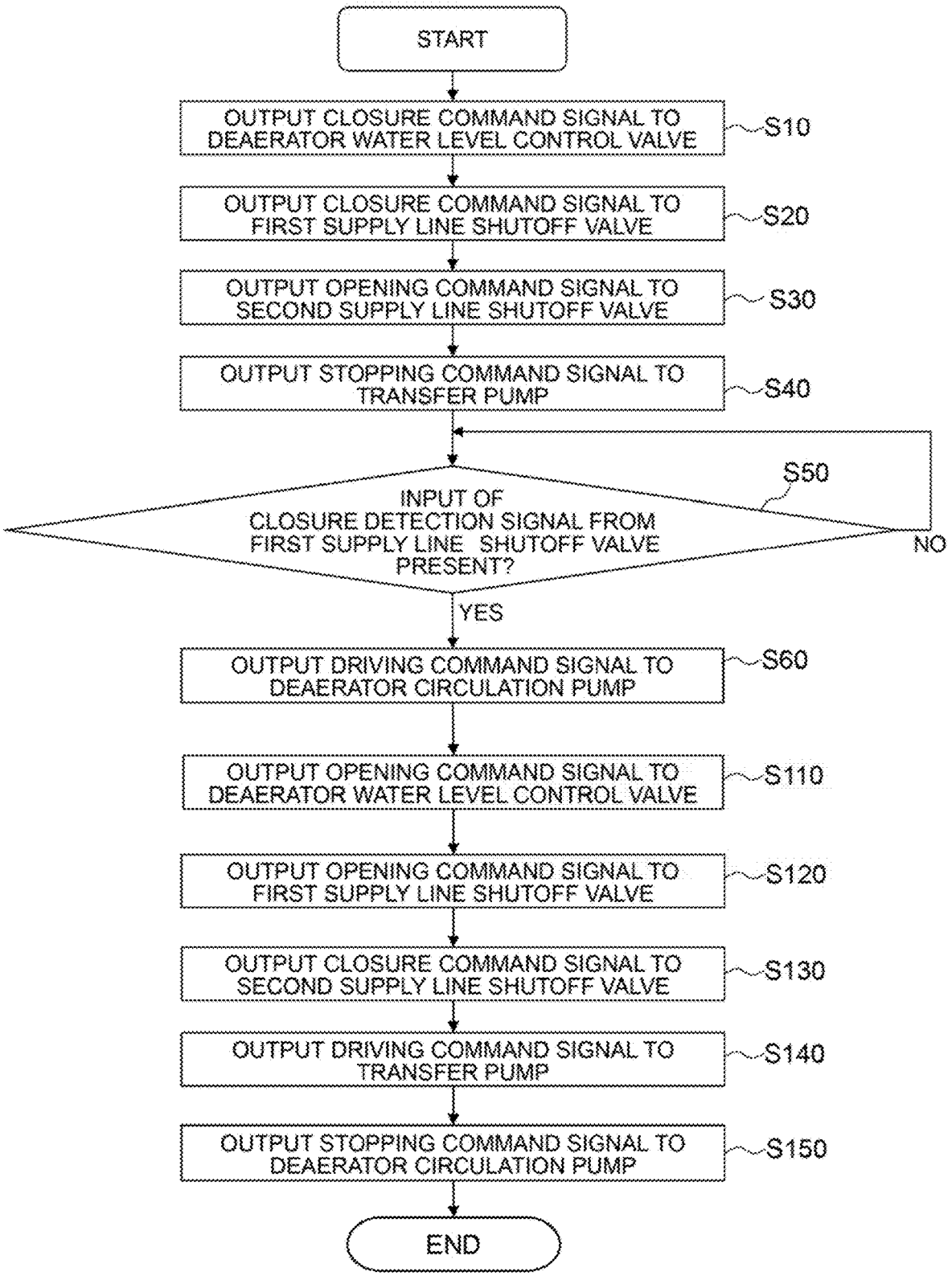
FIG. 6 is a flow chart depicting one example of control procedure from switching to condensate throttling to return to normal operation by the controller constituting a part of the condensate and feedwater system of the steam power plant according to one embodiment of the present invention.

Next, one example of a series of operation from switching to condensate throttling to return to normal operation of the steam power plant in the condensate and feedwater system will be described referring to FIGS. 1 and 4 to 6. FIG. 5 is an illustration of an operation method at the condensate throttling of the power plant in the condensate and feedwater system of the steam power plant according to one embodiment of the present invention. FIG. 6 is a flow chart depicting one example of control procedure from switching to condensate throttling to return to normal operation by the controller constituting a part of the condensate and feedwater system of the steam power plant according to one embodiment of the present invention.

In the steam power plant illustrated in FIG. 1, other than the normal operation, there is an operation called condensate throttling for coping with a rapid increase in the load on the generator 3. It may be impossible, in the case of a rapid increase in the load of the generator 3, to increase the amount of steam to be generated by the boiler 1 following up to the rapid increase in the load. In view of this, in the condensate throttling, the flow rate of the condensate water to be supplied to the LP heater 47 and the deaerator 42 is reduced rapidly, whereby flow rate of extraction steam from the steam turbine 2 used for heating in the LP heater 47 and the deaerator 42 id reduced, and the output power of the steam turbine 2 is increased accordingly.

When switching of operation mode from normal operation to condensate throttling of the steam power plant is conducted, an operation mode of condensate throttling is inputted to the controller 100. As a result, the controller 100 starts performing controls over various apparatuses of the condensate and feedwater system 4 according to the condensate throttling.

Specifically, the controller 100 depicted in FIG. 5 outputs a closure command signal to the deaerator water level control valve 46 (step S10 in FIG. 6). Besides, the controller 100 outputs a closure command signal to the first supply line shutoff valve 84 (step S20 in FIG. 6) and outputs an opening command signal to the second supply line shutoff valve 87 (step S30 in FIG. 6). In addition, the controller 100 outputs a stopping command signal to the transfer pump 85 (step S40 in FIG. 6). These four steps S10 to S40 may be performed concurrently, and the order of the steps S10 to S40 may be changed arbitrarily.

The deaerator water level control valve 46 and the first supply line shutoff valve 84 which are in an open state at the normal operation (referring to FIG. 4) start closing in response to inputting of the closure command signal from the controller 100. On the other hand, the second supply line shutoff valve 87 which is in a closed state at the normal operation (referring to FIG. 4) starts opening in response to inputting of the opening command signal from the controller 100. In addition, in response to inputting of a stopping command signal from the controller 100, the transfer pump 85 gradually lowers the pump output power and thereafter stops.

With the condensate line 43 interrupted due to rapid closing of the deaerator water level control valve 46, the flow rate of the condensate water flowing through the condensate line 43 including the first to fourth LP heaters 47*a*, 47*b*, 47*c*, and 47*d* depicted in FIG. 1 is reduced rapidly. According to this rapid reduction in the flow rate of the condensate water, the extraction steam supplied from the LP turbine 23 to the first to fourth LP heaters 47*a*, 47*b*, 47*c*, and 47*d* via the first to fourth extraction steam piping 61, 62, 63, and 64 is throttled. Since the flow rate of the steam for driving the LP turbine 23 is increased according to the decrease in supply of the extraction steam from the LP turbine 23, output power of the steam turbine 2 is increased, and it is possible to cope with a temporary rapid increase in the load on the generator 3.

In addition, the first supply line 82 is interrupted due to the closure of the first supply line shutoff valve 84 illustrated in FIG. 5 and the transfer pump 85 is stopped, whereby supply of the condensate water to the condensate heat exchanger 81 via the first supply line 82 is interrupted. On the other hand, the second supply line 86 is put into a communicating state due to the opening of the second supply line shutoff valve 87, whereby water is supplied to the condensate heat exchanger 81 via the second supply line 86. The water supplied to the condensate heat exchanger 81 via the second supply line 86 is introduced into the deaerator 42 via the outlet line 83.

In this way, even when the supply of condensate water to the condensate heat exchanger 81 via the first supply line 82 is interrupted according to a reduction in flow rate of the condensate water by the switching to condensate throttling, water from another supply source is supplied to the condensate heat exchanger 81 via the second supply line 86. Therefore, the condensate heat exchanger 81 can be prevented from being damaged by the heat of the exhaust gas from the boiler 1 (illustrated in FIG. 1).

Incidentally, the deaerator water level control valve 46 is an air operated valve, whereas the first supply line shutoff valve 84 and the second supply line shutoff valve 87 are motor operated valves. While the deaerator water level control valve 46 which is an air operated valve completes the transfer from an open state to a closed state in a short period of time, i.e. closes rapidly, the first supply line shutoff valve 84 which is a motor operated valve takes more time to complete the transfer to a closed state than the deaerator water level control valve 46. Therefore, at the time of switching from normal operation to condensate throttling, even after the transfer of the deaerator water level control valve 46 to the closed state is completed and the condensate line 43 is interrupted, the first supply line 82 is temporarily in a communicating state until the transfer of the first supply line shutoff valve 84 to the closed state is completed, for example, for several minutes.

Figure 11:
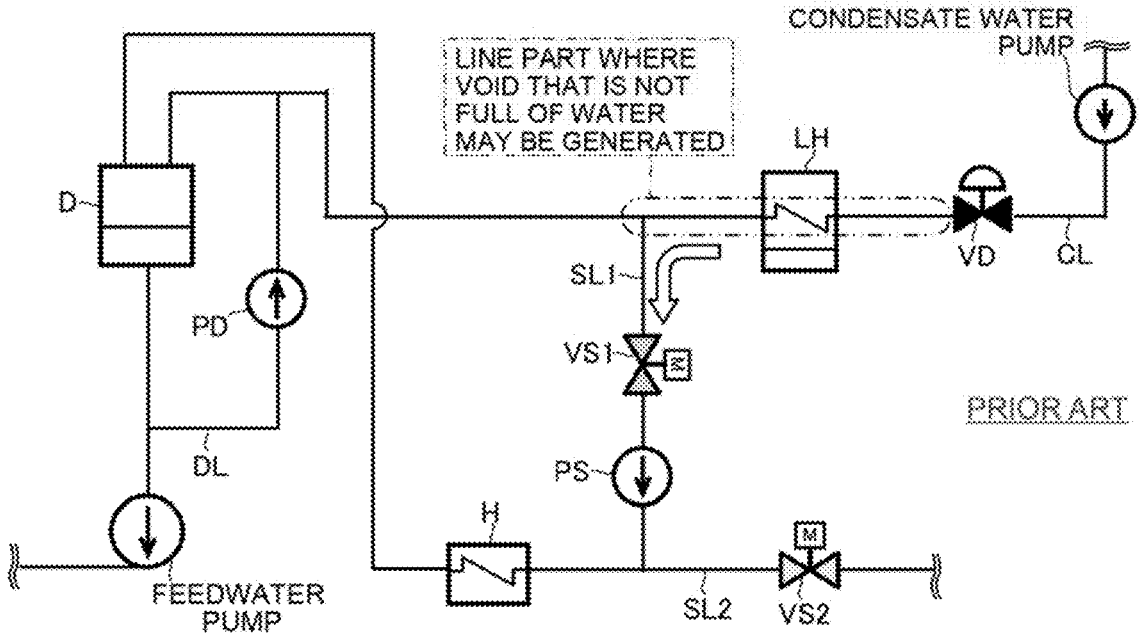
FIG. 11 is an illustration depicting a state at the time of switching from normal operation to condensate throttling in the condensate and feedwater system illustrated in FIG. 10.

For this reason, the conventional operation method at the time of switching from normal operation to condensate throttling has the following problem. As illustrated in FIG. 11, throughout the period from the time when the first supply line shutoff valve VS1 starts closing to the time when it completes the closing (transfer from an open state to a closed state), the condensate water on the condensate line CL on the downstream side from the deaerator water level control valve VD is supplied to the condensate heat exchanger H via the first supply line SL1 by the transfer pump PS. Therefore, there is a fear that a part of the condensate line CL on the downstream side from the deaerator water level control valve VD (the part of alternate long and two short dashes line in FIG. 11) may not be filled up with water and may be voided. If return from condensate throttling to normal operation is conducted in such a state, an opening of the deaerator water level control valve VD causes the condensate water to rapidly flow into the void part of the condensate line CL on the downstream side of the deaerator water level control valve VD. As a result, there is a possibility of generation of a phenomenon called water hammer in which a piping receives a shock and is vibrated severely.

In view of this, in the present embodiment, the deaerator circulation system which does not operate during condensate throttling in the conventional art is driven, thereby eliminating the void part (the non-full-water state) of the condensate line 43 generated at the time of switching from normal operation to condensate throttling.

Specifically, the controller 100 illustrated in FIG. 5, after steps S10 to S40, determines the starting time of the deaerator circulation system. In the present embodiment, the deaerator circulation pump 72 is started after the first supply line shutoff valve 84 is put into a closed state and the first supply line 82 is interrupted. The controller 100 determines, for example, the presence or absence of an input of a closure detection signal from the first supply line shutoff valve 84 (step S50). The first supply line shutoff valve 84, upon reaching a closed state according to the closure command signal from the controller 100 (step S20), detects the closed state by a switch or the like, and outputs a closure detection signal to the controller 100.

In the case where it is determined in step S50 that an input of a closure detection signal from the first supply line shutoff valve 84 is absent, i.e. NO, the controller 100 returns to step S50 again, and determines the presence or absence of a closure detection signal from the first supply line shutoff valve 84. This step (step S50) is repeated until it is determined that an input of the closure detection signal from the first supply line shutoff valve 84 is present, i.e. YES. In the case where determination in step S50 is YES, the controller 100 proceeds to step S60, and outputs a driving command signal to the deaerator circulation pump 72.

The deaerator circulation pump 72 is driven in response to the driving command signal from the controller 100. By the driving of the deaerator circulation pump 72, part of the condensate water sent out from the deaerator 42 to the HP heater 53 (illustrated in FIG. 1) is caused to flow into the condensate line 43*a* between the LP heater 47 and the deaerator 42 via the deaerator circulation line 71. Since the first supply line 82 is interrupted due to closure of the first supply line shutoff valve 84, the condensate water having flowed into the condensate line 43*a* flows into the void part generated on the downstream side from the deaerator water level control valve 46 in the condensate line 43, and the condensate line 43 gets filled up with water. When the condensate line 43 is filled up with water, the condensate water having flowed into the condensate line 43*a* on the upstream side from the deaerator via the deaerator circulation line 71 by the deaerator circulation pump 72 is introduced into the deaerator 42 again and is circulated. Note that in the present embodiment, the deaerator circulation pump 72 continues to be driven until condensate throttling is finished.

Thereafter, when switching for returning from condensate throttling to normal operation is performed, an operation mode of normal operation is inputted to the controller 100. As a result, the controller 100 performs controls over various apparatuses of the condensate and feedwater system 4 according to normal operation.

Specifically, the controller 100 depicted in FIG. 4 outputs an opening command signal to the deaerator water level control valve 46 (step S110 in FIG. 6). Besides, the controller 100 outputs an opening command signal to the first supply line shutoff valve 84 (step S120 in FIG. 6), and outputs a closure command signal to the second supply line shutoff valve 87 (step S130 in FIG. 6). In addition, the controller 100 outputs a driving command signal to the transfer pump 85 (step S140 in FIG. 6), and outputs a stopping command signal to the deaerator circulation pump 72 (step S150 in FIG. 6). These five steps S110 to S150 may be performed concurrently, and the order of steps S110 to S150 may be changed arbitrarily.

The deaerator water level control valve 46 which is in the closed state at the condensate throttling (illustrated in FIG. 5) gets opened in response to an opening command signal from the controller 100. As a result, the condensate water on the upstream side from the deaerator water level control valve 46 flows into the condensate line 43 on the downstream side thereof. In the present embodiment, the condensate line 43 on the downstream side from the deaerator water level control valve 46 is filled up with water by the driving of the deaerator circulation pump 72 at the condensate throttling, and, therefore, a water hammer phenomenon would not occur when the condensate water flows into the condensate line 43 on the downstream side from the deaerator water level control valve 46.

In addition, the deaerator circulation pump 72 stops driving thereof in response to a stopping command signal from the controller 100. As a result, the condensate water flowing out from the deaerator 42 is not circulated through the deaerator 42 via the deaerator circulation line 71, but is supplied to the boiler 1 via the HP heater 53 by the feedwater pump 52.

In addition, the first supply line shutoff valve 84 which is in a closed state at the condensate throttling (illustrated in FIG. 5) gets opened in response to an opening command signal from the controller 100, whereas the second supply line shutoff valve 87 which is in an open state at the condensate throttling (illustrated FIG. 5) gets closed in response to a closure command signal from the controller 100. Besides, the transfer pump 85 gets driven in response to a driving command signal from the controller 100. As a result, part of the condensate water flowing on the condensate line 43*a* from the LP heater 47 toward the deaerator 42 is supplied to the condensate heat exchanger 81 via the first supply line 82 by the transfer pump 85. On the other hand, by the closure of the second supply line shutoff valve 87, the supply of water to the condensate heat exchanger 81 via the second supply line 86 is interrupted.

In this way, in the present operation method, even in the case where the condensate line 43 on the downstream side from the deaerator water level control valve 46 gets in the state of being not filled up with water due to the switching from normal operation to condensate throttling, it is possible to return the condensate line 43 into the state of being filled up with water during the condensate throttling by continuously driving the deaerator circulation system during condensate throttling to return the condensate water flowing out from the deaerator 42 to the condensate line 43*a* on the upstream side from the deaerator 42.

In addition, in the present operation method, the deaerator circulation system is started after a closure detection signal is inputted from the first supply line shutoff valve 84, i.e., after the transfer from the open state to the closed state of the first supply line shutoff valve 84 is completed. Therefore, the condensate water having flowed into the condensate line 43*a* via the deaerator circulation line 71 by the deaerator circulation pump 72 can be caused to flow into the void part of the condensate line 43, without being branched to the first supply line 82 side via the first supply line shutoff valve 84.

Figure 7:
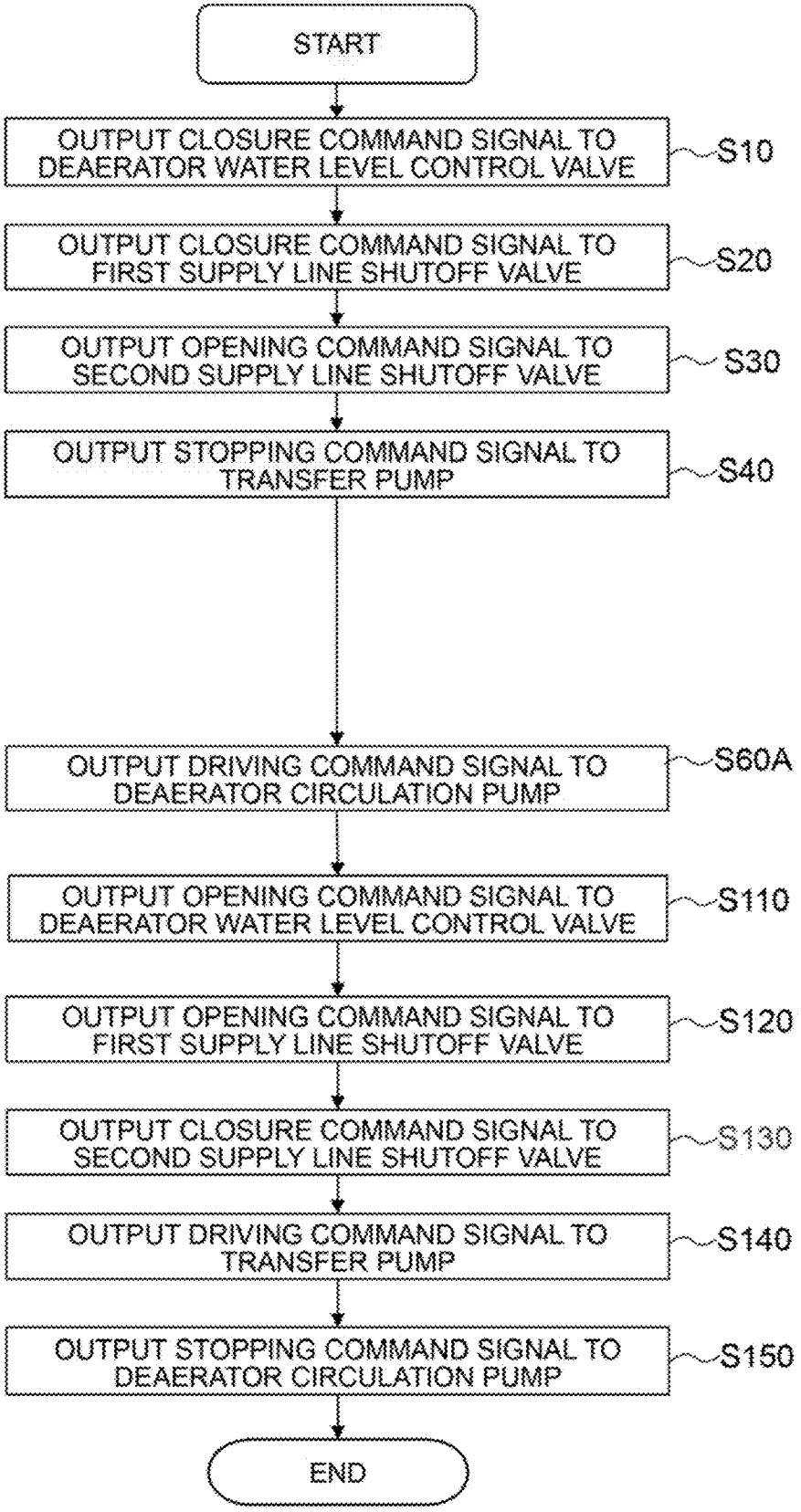
FIG. 7 is a flow chart depicting another example of control procedure from switching to condensate throttling to return to normal operation by the controller constituting a part of the condensate and feedwater system of the steam power plant according to one embodiment of the present invention.

Next, another example of the series of operation from switching to condensate throttling to return to normal operation of the steam power plant in the condensate and feedwater system will be described referring to FIGS. 5 and 7. FIG. 7 is a flow chart depicting another example of control procedure from the switching to condensate throttling to the return to normal operation by the controller constituting a part of the condensate and feedwater system of the steam power plant according to one embodiment of the present invention.

Another example of operation method depicted in FIG. 7 differs from one example of operation method illustrated in FIG. 6 described above in that a timing of starting the deaerator circulation pump 72 at the time of switching from normal operation to condensate throttling is different. In the one example of operation method illustrated in FIG. 6 described above, the deaerator circulation pump 72 is started after the transfer to the closed state of the first supply line shutoff valve 84 is completed. On the other hand, in the present operation method, the deaerator circulation pump 72 is started concurrently with the start of closing the first supply line shutoff valve 84. Other procedures (steps) of the present operation method are similar to the procedures of the operation method depicted in FIG. 6 described above.

Specifically, the controller 100 omits step S50 in FIG. 6 of determining the presence or absence of an input of a closure detection signal from the first supply line shutoff valve 84, and starts outputting a driving command signal to the deaerator circulation pump 72 (step S60A in FIG. 7) after performing steps S10 to S40 in FIG. 7 (steps in common with steps S10 to S40 in FIG. 6). This step S60A is carried out concurrently with the four steps S10 to S40. In other words, the order of steps S10 to S40 and step S60A may be changed arbitrarily.

In the present operation method, by the driving of the deaerator circulation pump 72, part of the condensate water sent out from the deaerator 42 to the HP heater 53 flows into the condensate line 43*a* between the LP heater 47 and the deaerator 42 via the deaerator circulation line 71. This part of condensate water, in a situation in which the first supply line shutoff valve 84 is under the closing action and the first supply line 82 remains in a communicating state, flows to the condensate heat exchanger 81 side via the first supply line 82, together with the condensate water on the condensate line 43 on the downstream side from the deaerator water level control valve 46. Therefore, the flow rate of the condensate water flowing into the first supply line 82 from the condensate line 43 on the downstream side from the deaerator water level control valve 46 is reduced, and the part not filled up with water on the condensate line 43 on the downstream side from the deaerator water level control valve 46 get smaller than that in the operation method depicted in FIG. 6 described above. Besides, in the present operation method, the starting time of the deaerator circulation pump 72 is earlier than that in the operation method depicted in FIG. 6 described above, and, therefore, the condensate line 43 can be put into the state of being filled up with water earlier as compared to the operation method depicted in FIG. 6 described above.

As aforementioned, according to the condensate and feedwater system of the steam power plant and the operation method therefor according to one embodiment of the present invention, the deaerator circulation system of the conventional configuration is driven at the condensate throttling. Therefore, even in the case where the condensate line 43 on the downstream side from the deaerator water level control valve 46 is in the state of being not filled up with water due to the switching from normal operation to condensate throttling, it is possible to return the condensate line 43 into the state of being filled up with water during the condensate throttling by causing the condensate water flowing out from the deaerator 42 to return to the condensate line 43*a* on the upstream side from the deaerator 42. Accordingly, generation of water hammer at the time of return from condensate throttling to normal operation can be prevented, without changing the plant configuration.

In addition, according to the present embodiment, the deaerator circulation system is continuously driven during the condensate throttling; therefore, the void part generated in the condensate line 43 on the downstream side from the deaerator water level control valve 46 can securely be put into the state of being filled up with water.

Modification of One Embodiment

Figure 8:
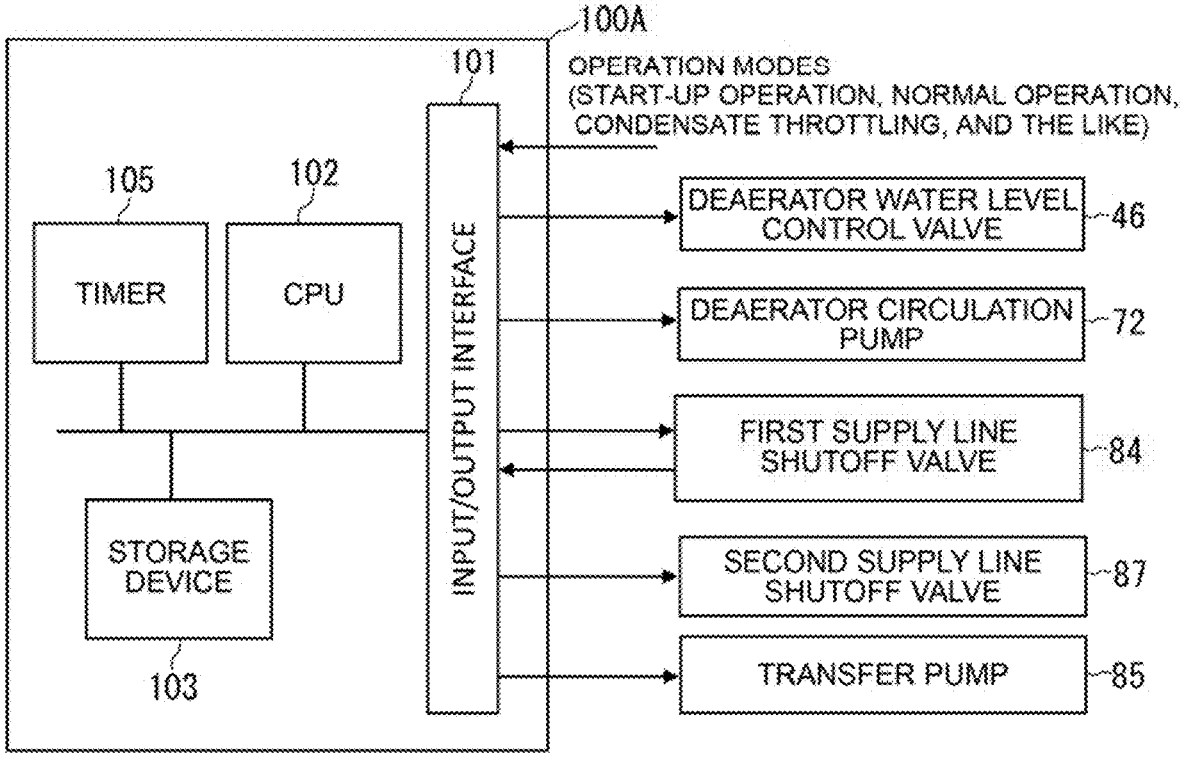
FIG. 8 is a configuration diagram depicting hardware of a controller constituting a part of a condensate and feedwater system of a steam power plant according to a modification of one embodiment of the present invention.

Next, a configuration of a condensate and feedwater system of a steam power plant according to a modification of one embodiment of the present invention will be described referring to FIG. 8. FIG. 8 is a configuration diagram depicting hardware of a controller constituting a part of the condensate and feedwater system of the steam power plant according to the modification of one embodiment of the present invention.

The condensate and feedwater system of the steam power plant according to the modification of one embodiment of the present invention differs from the condensate and feedwater system of the steam power plant according to one embodiment of the present invention in that a controller 100A further includes a timer 105 in addition to an input/output interface 101, a CPU 102, and a storage device 103 as components of hardware. The timer 105 measures lapse time T1 from the start of outputting of a closure command signal to the first supply line shutoff valve 84, and measures lapse time T2 from the start of outputting of a driving command signal to the deaerator circulation pump 72. Preset time t1 and t2 are preliminarily stored in the storage device 103 for comparison with lapse times T1 and T2. The preset t1 is for determining a starting timing of the deaerator circulation pump 72. The preset time t1 is, for example, an actual value obtained by preliminary measurement of transfer time from a full open state to a closed state of the first supply line shutoff valve 84, and a time sufficient for regarding that the transfer to the closed state of the first supply line shutoff valve 84 is completed by an opening/closing control of the controller 100A. The preset t2 is for determining a timing of stopping driving the deaerator circulation pump 72. The reset time t2 is specified, for example, as a time required for the void part generated in the condensate line 43 on the downstream side from the deaerator water level control valve 46 to be put into the state of being filled up with water by the deaerator circulation pump 72. The preset time t2 can be set by taking into consideration the volume of the condensate line 43 on the downstream side from the deaerator water level control valve 46 and the delivery flow rate of the deaerator circulation pump 72.

Figure 9:
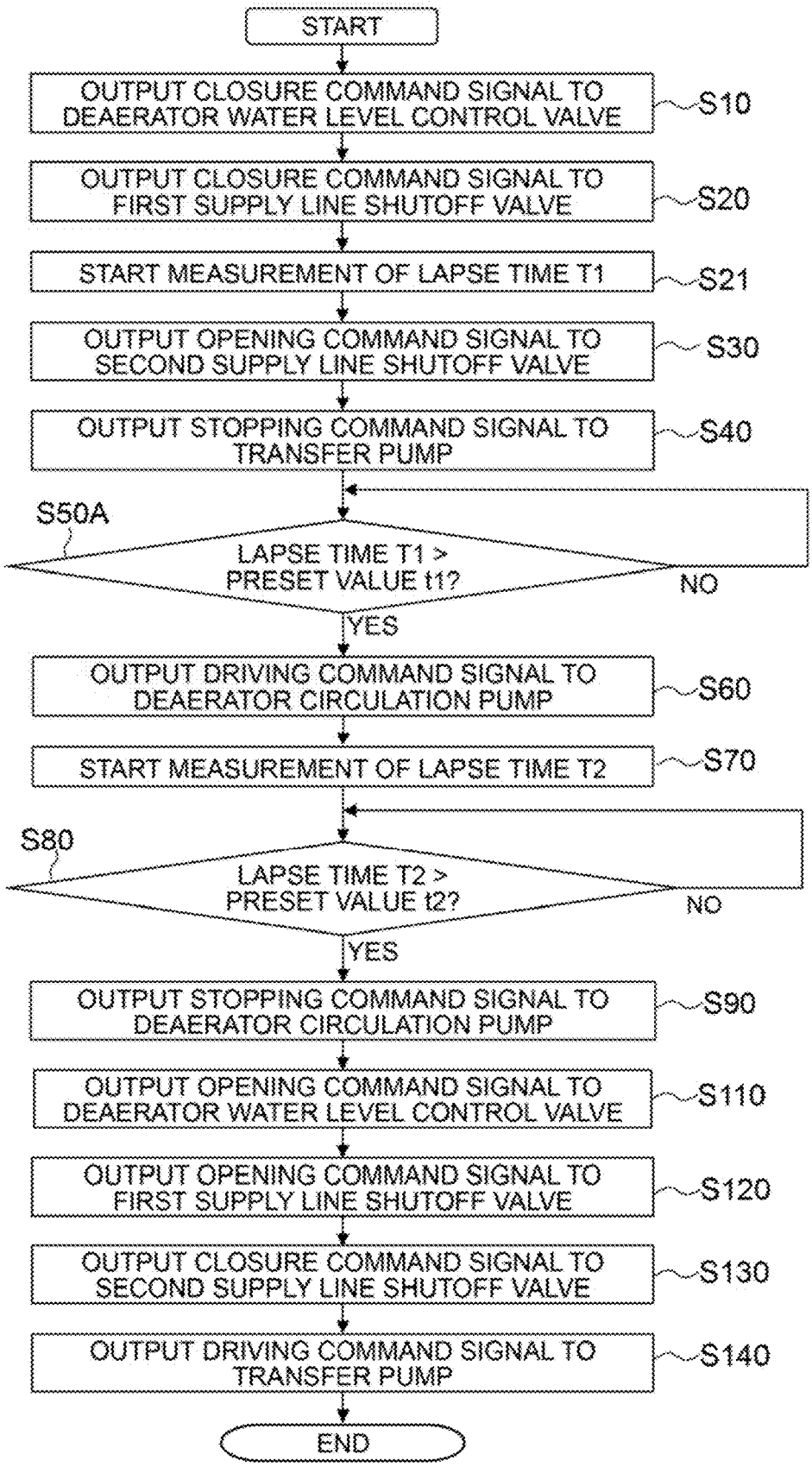
FIG. 9 is a flow chart depicting one example of control procedure from switching to condensate throttling to return to normal operation by the controller constituting a part of the condensate and feedwater system of the steam power plant according to the modification of one embodiment of the present invention.
Figure 10:
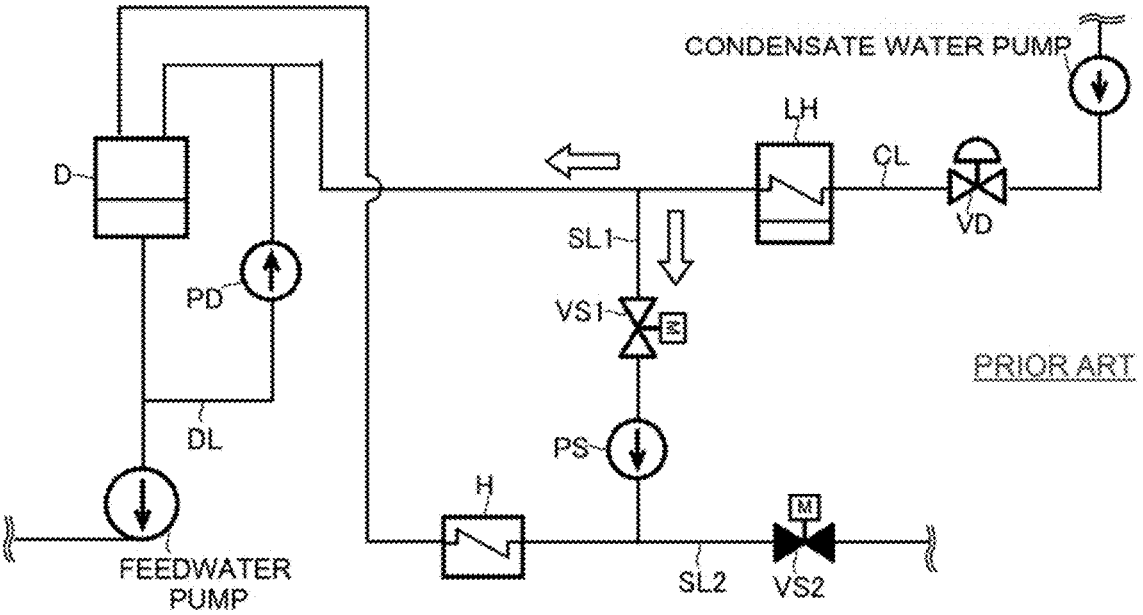
FIG. 10 is a schematic system diagram depicting a part of a conventional configuration of a condensate and feedwater system of a steam power plant.

Next, one example of a series of operations from switching to condensate throttling to return to normal operation of the steam power plant in the condensate and feedwater system of the steam power plant according to the modification of one embodiment of the present invention will be described referring to FIGS. 5 and 9. FIG. 9 is a flow chart depicting one example of control procedure from switching to condensate throttling to return to normal operation by the controller constituting a part of the condensate and feedwater system of the steam power plant according to the modification of one embodiment of the present invention.

The operation method of the modification of one embodiment of the present invention depicted in FIG. 9 differs from the operation method of one embodiment of the present invention illustrated in FIG. 6 in that determination method of a timing of starting the deaerator circulation pump 72 at the condensate throttling is different and in that the driving continuation time of the deaerator circulation pump 72 at the condensate throttling is different. In the operation method depicted in FIG. 6 described above, the timing of starting the deaerator circulation pump 72 is determined by the presence or absence of an input of a closure detection signal from the first supply line shutoff valve 84 (step S50 in FIG. 6). On the other hand, in the present operation method, the timing of starting the deaerator circulation pump 72 is determined based on lapse time T1 from the start of outputting of the closure command signal to the first supply line shutoff valve 84 (step S50A in FIG. 9). Besides, in the operation depicted method in FIG. 6 described above, the deaerator circulation pump 72 is continuously driven throughout condensate throttling. On the other hand, in the present operation method, the deaerator circulation pump 72 is driven for only a predetermined period at condensate throttling. Accordingly, in the present operation method, the procedure of stopping driving the deaerator circulation pump 72 at the time of returning from condensate throttling to normal operation (step S150 in FIG. 6) is omitted. The other procedures (steps) of the present operation method are similar to those of the operation method in FIG. 6 described above.

Specifically, the controller 100A, after outputting a closure command signal to the first supply line shutoff valve (the common step S20 for FIG. 6 and FIG. 9), starts measurement of lapse time T1 from the start of outputting of the closure command signal to the first supply line shutoff valve 84 (step S21 in FIG. 9). Thereafter, after performing the common steps S30 to S40 in FIG. 6 and FIG. 9, the controller 100A determines whether or not the lapse time T1 measured exceeds a preset time t1 preliminarily stored in the storage device 103 (step S50A in FIG. 9). This step (step S50A) regards that the transfer from an open state to a closed state of the first supply line shutoff valve 84 is completed, based on the lapse time T1 from the start of a closing operation of the first supply line shutoff valve 84, thereby determining a timing of starting the deaerator circulation pump 72.

When the lapse time T1 is smaller than the preset time t1 in step S50A, i.e. in the case of NO, the controller 100A returns to step S50A again, and determines whether or not the lapse time T1 exceeds the preset time t1. This step (step S50A) is repeated until it is determined that the lapse time T1 is greater than the preset time t1 (YES). When the determination in step S50A is YES, i.e., it is regarded that the transfer from the open state to the closed state of the first supply line shutoff valve 84 is completed, the controller 100A proceeds to step S60 which is common in FIG. 6, and starts outputting a driving command signal to the deaerator circulation pump 72.

Next, the controller 100A starts measurement of lapse time T2 from the start of outputting of the driving command signal to the deaerator circulation pump 72 (step S70 in FIG. 9). Subsequently, the controller 100A determines whether or not the lapse time T2 measured exceeds a preset time t2 preliminarily stored in the storage device 103 (step S80 in FIG. 9). This step (step S80) regards that the void part of the condensate line 43 on the downstream side from the deaerator water level control valve 46 has changed into the state of being filled up with water, based on the lapse time T2 from the start of the deaerator circulation pump 72, thereby determining a timing of stopping driving the deaerator circulation pump 72.

When the lapse time T2 is smaller than the preset time t2 in step S80 (NO), the controller 100A returns to step S80 again, and determines whether or not the lapse time T2 exceeds the preset time t2. This step (step S80) is repeated until it is determined that the lapse time T2 is greater than the preset time t2 (YES). When the determination in step S80 is YES, i.e., it is regarded that the void part of the condensate line 43 on the downstream side from the deaerator water level control valve 46 has changed to the state of being filled up with water, the controller 100A proceeds to step S90, and outputs a stopping command signal to the deaerator circulation pump 72. As a result, the deaerator circulation pump 72 is put into a stopped state during condensate throttling.

In the present operation method, the timing of starting the deaerator circulation system is determined based on the lapse time T1 from the start of outputting of the closure command signal to the first supply line shutoff valve 84. Therefore, the controller 100A does not need an input of a closure detection signal from the first supply line shutoff valve 84 as that in the operation method in FIG. 6 described above, and, accordingly, an input signal line from the first supply line shutoff valve 84 is unnecessary.

Besides, in the present operation method, the deaerator circulation system is driven for only a predetermined period at condensate throttling. Therefore, the amount of electric power consumed by accessories can be reduced, as compared to the operation method in FIG. 6 described above in which the deaerator circulation system is continuously driven throughout condensate throttling. Particularly, the condensate throttling is an operation in which the output power of the steam turbine 2 (illustrated in FIG. 1) is increased correspondingly to an increase in the load on the generator, and there is a demand for reducing, as much as possible, the consumption of output power of the steam turbine 2 by accessories.

As aforementioned, in the condensate and feedwater system of the steam power plant and the operation method therefor according to the modification of one embodiment of the present invention, the deaerator circulation system of the conventional configuration is temporarily driven at condensate throttling. Therefore, even in the case where the condensate line 43 on the downstream side from the deaerator water level control valve 46 has been put out of the state of being filled up with water due to the switching from normal operation to condensate throttling, it is possible, by returning the condensate water flowing out from the deaerator 42 to the condensate line 43*a* on the upstream side from the deaerator 42, to return the condensate line 43 into the state of being filled up with water during condensate throttling. Accordingly, generation of water hammer at the time of returning from condensate throttling to normal operation can be prevented, without changing the plant configuration.

Other Embodiments

Note that the present invention is not limited to the above-described embodiment and includes various modifications. The above embodiment has been described in detail for explaining the present invention in an easy-to-understand manner, and is not necessarily limited to an embodiment including all the described components. For example, part of the configuration of an embodiment can be replaced by a configuration of another embodiment, and a configuration of other embodiment can be added to the configuration of an embodiment. In addition, in regard of part of the configuration of each embodiment, addition, deletion, and replacement of other configuration can be made. Note that, of control lines and the like, those considered to be necessary for explanation are illustrated, and all the control lines and information lines on a product basis are not necessarily depicted. In practice, substantially all the components may be considered to be mutually connected.

In addition, in one embodiment and its modification described above, the configuration in which the condensate heat exchanger 81 is used as an apparatus to be supplied via the first supply line 82 with part of the condensate water flowing from the LP heater 47 toward the deaerator 42 has been mentioned as an example. However, the apparatus may be any apparatus that is supplied with part of the condensate water flowing from the LP heater 47 toward the deaerator 42 via the first supply line 82 branched from the condensate line 43*a* except the condensate heat exchanger 81.

Besides, in one embodiment and its modification described above, the configurations of the controllers 100 and 100A that output stopping command signals for commanding the deaerator circulation pump 72 and the transfer pump 85 to stop driving thereof have been mentioned as an example. However, the controller can be configured such as to stop driving of the deaerator circulation pump 72 and the transfer pump 85 by stopping outputting of the driving command signals.

In addition, in the modification of one embodiment described above, the configuration of the controller 100A that determines the starting timing of the deaerator circulation pump 72 based on the lapse time T1 from the start of outputting of the closure command signal to the first supply line shutoff valve 84 has been mentioned as an example. However, the controller 100A can be configured such as to start the deaerator circulation pump 72 simultaneously with the start of closing the first supply line shutoff valve 84. In other words, in the operation method depicted in FIG. 9, the measurement of the lapse time T1 in step S21 and the determination of the lapse time T1 in step S50A can be omitted.

Besides, in the modification of one embodiment described above, the configuration of the controller 100A that determines a timing of stopping driving the deaerator circulation pump 72 based on the lapse time T2 from the start of outputting of the driving command signal to the deaerator circulation pump 72 has been mentioned as an example. However, the controller 100A can be configured such as to continuously drive the deaerator circulation pump 72 throughout condensate throttling. In other words, in the operation method illustrated in FIG. 9, the measurement of the lapse time T2 in step S70, the determination of the lapse time T2 in step S80, and the outputting of the stopping command signal to the deaerator circulation pump 72 in step S90 can be omitted.

What is claimed is:

1. A condensate and feedwater system of a steam power plant, comprising:

a deaerator that heats and deaerates condensate water generated in a condenser, by extraction steam of a steam turbine, and temporarily stores the heated and deaerated condensate water;

a heater disposed on a condensate line between the condenser and the deaerator, the heater being configured to heat the condensate water generated in the condenser, by extraction steam of the steam turbine;

a deaerator water level control valve disposed on an upstream side of the heater in the condensate line, the deaerator water level control valve being capable of controlling water level of the condensate water in the deaerator;

a deaerator circulation pump that returns condensate water flowing out from the deaerator to a part of the condensate line between the heater and the deaerator;

an apparatus configured to be supplied with part of the condensate water flowing from the heater toward the deaerator, through a supply line branched from the condensate line;

a supply line shutoff valve disposed on the supply line, the supply line shutoff valve being configured to switch between communication and interruption of the supply line; and a controller that controls opening/closing of the supply line shutoff valve and controls driving/stopping of the deaerator circulation pump, wherein the controller puts the supply line shutoff valve into an open state and puts the deaerator circulation pump into a stopped state, in normal operation, and closes the supply line shutoff valve from the open state at the normal operation and at least temporarily drives the deaerator circulation pump from the stopped state at the normal operation, in condensate throttling in which supply of the extraction steam to the heater and the deaerator is reduced as compared to that at the normal operation and the deaerator water level control valve is closed.

2. The condensate and feedwater system of the steam power plant according to claim 1, wherein the controller starts outputting of a driving command signal to the deaerator circulation pump when a closure detection signal indicating that completion of a transfer from the open state to a closed state of the supply line shutoff valve is detected is inputted from the supply line shutof valve, in the condensate throttling.

3. The condensate and feedwater system of the steam power plant according to claim 1, wherein the controller measures lapse time from start of outputting of a closure command signal to the supply line shutoff valve, and starts outputting of a driving command signal to the deaerator circulation pump when the lapse time measured exceeds a preset time, in the condensate throttling.

4. The condensate and feedwater system of the steam power plant according to claim 1, wherein the controller starts outputting of a driving command signal to the deaerator circulation pump concurrently with start of outputting of a closure command signal to the supply line shutoff valve, in the condensate throttling.

5. The condensate and feedwater system of the steam power plant according to claim 1, wherein the controller continues driving of the deaerator circulation pump throughout the condensate throttling.

6. The condensate and feedwater system of the steam power plant according to claim 1, wherein the controller measures lapse time from start of outputting of a driving command signal to the deaerator circulation pump, and either starts outputting of a stopping command signal to the deaerator circulation pump or stops outputting of the driving command signal when the lapse time measured exceeds a preset time, in the condensate throttling.

7. An operation method for a condensate and feedwater system of a steam power plant, the condensate and feedwater system including:

a deaerator that heats and deaerates condensate water generated in a condenser, by extraction steam of a steam turbine, and temporarily stores the heated and deaerated condensate water;

a heater disposed on a condensate line between the condenser and the deaerator, the heater being configured to heat the condensate water generated in the condenser, by extraction steam of the steam turbine;

a deaerator water level control valve disposed on an upstream side of the heater in the condensate line, the deaerator water level control valve being capable of controlling water level of the condensate water in the deaerator;

a deaerator circulation system that returns condensate water flowing out from the deaerator to a part of the condensate line between the heater and the deaerator;

an apparatus configured to be supplied with part of the condensate water flowing from the heater toward the deaerator, through a supply line branched from the condensate line; and a supply line shutoff valve configured to switch between communication and interruption of the supply line, the operation method comprising:

when switching from normal operation to condensate throttling in which supply of the extraction steam to the heater and the deaerator is reduced as compared to that at the normal operation and the deaerator water level control valve is closed, closing the supply line shutoff valve from an open state at the normal operation; and at least temporarily driving the deaerator circulation system from a stopped state at the normal operation.

8. The operation method for the condensate and feedwater system of the steam power plant according to claim 7, wherein in the condensate throttling, the deaerator circulation system is started after completion of transfer from the open state to the closed state of the supply line shutoff valve.

9. The operation method for the condensate and feedwater system of the steam power plant according to claim 7, wherein in the condensate throttling, the deaerator circulation system is started after a lapse of a preset time from start of closing of the supply line shutoff valve.

10. The operation method for the condensate and feedwater system of the steam power plant according to claim 7, wherein in the condensate throttling, the deaerator circulation system is started concurrently with start of a closing operation of the supply line shutoff valve.

11. The operation method for the condensate and feedwater system of the steam power plant according to claim 7, wherein the deaerator circulation system continues being driven throughout the condensate throttling.

12. The operation method for the condensate and feedwater system of the steam power plant according to claim 7, wherein in the condensate throttling, the deaerator circulation system is stopped after a lapse of a preset time from start of its driving.

* * * * *